United States Patent [19]

Weatherly

[11] Patent Number: 4,767,092

[45] Date of Patent: Aug. 30, 1988

[54] CUP RETENTION APPARATUS

[76] Inventor: Jerry E. Weatherly, 3329 E. Seneca, Tucson, Ariz. 85716

[21] Appl. No.: 127,130

[22] Filed: Dec. 1, 1987

[51] Int. Cl.[4] ..... A47K 1/08

[52] U.S. Cl. ..... 248/311.2; 248/214

[58] Field of Search ..... 248/311.2, 313, 316.1, 248/310, 314, 214, 215, 304; 220/85 H; 224/148, 42.45 R; 108/46

[56] References Cited

U.S. PATENT DOCUMENTS

| | | | |
|---|---|---|---|
| D. 226,623 | 4/1973 | Shuford | D 7/70 |
| D. 265,351 | 7/1982 | Wooters . | |
| 3,314,635 | 4/1967 | Frye | 248/311 |
| 3,837,047 | 9/1974 | Bunnell | 24/16 PB |
| 4,319,385 | 3/1982 | Marchou | 24/16 PB X |
| 4,418,448 | 12/1983 | Sauer | 24/16 PB |
| 4,606,523 | 8/1986 | Statz | 248/311.2 |
| 4,629,153 | 12/1986 | Marcum | 224/42.45 X |
| 4,634,089 | 1/1987 | Wright | 248/311.2 |
| 4,655,425 | 4/1987 | Wallace | 248/311.2 |
| 4,678,154 | 7/1987 | McFarland | 248/311.2 |

*Primary Examiner*—J. Franklin Foss

*Attorney, Agent, or Firm*—Henderson & Sturm

[57] ABSTRACT

A cup retention apparatus (10) comprising an adjustable receptacle retention unit (11) connected to a partially flexible support arm unit (12) having a generally rigid insert element (28) adapted to engage the interior surfaces of a vehicle (100); wherein the cup retention apparatus (10) is further provided with a stiffening unit (13) that may selectively engage and provide rigidity to the flexible portion (27) of the partially flexible support arm unit (12).

7 Claims, 1 Drawing Sheet

CUP RETENTION APPARATUS

TECHNICAL FIELD

This invention relates in general to a support for beverage receptacles, and in particular to support devices for beverage receptacles which cooperate with the interior of an automobile vehicle.

BACKGROUND OF THE INVENTION

As can be seen by reference to the following U.S. Pat. Nos.: 3,314,635; 4,655,425; 4,634,089; and D265,351, the prior art is replete with myriad and diverse beverage receptacle support devices which are adapted to cooperate or engage with the interior of an automobile.

While the prior art constructions are more than adequate for the purpose and function for which they were specifically designed, they do suffer from a number of shared deficiencies.

For instance, most of the prior art constructions lack an adjustment feature to compensate for different sized cup diameters. These deficiencies cause problems because the cup is held too loosely, allowing it to freely vibrate, thereby causing unwanted noise and spillage.

In addition, another common deficiency in the prior art involves the fact that the attachment arm is not normally conformed or configured to adapt to the individual curved surfaces of a variety of vehicle interiors. This lack of conformity permits vibrations to be transmitted to the receptacle holder, again causing spillage of the contents of the container.

Furthermore, most of the prior art constructions employ rigid structural components which limit the number of vehicle interiors that will readily accept them.

Also, it should be noted that virtually all of the prior art constructions employ fixed diameter cup encircling arms as their receptacle capture means.

Obviously there has been a long standing need for a cup retention device for automobiles which incorporates the features of flexibility, adjustability, and adaptability. And the development of such a device is the stated purpose and objective of the present invention.

BRIEF SUMMARY OF THE INVENTION

The cup retention apparatus that forms the basis of the present invention comprises in general an adjustable receptacle retention unit, a support arm unit, and a stiffening unit. The retention unit comprises in general a support member provided with a pair of cooperating arm members; wherein the arm members are adapted to releasably and adjustably engage one another, to frictionally engage the periphery of a beverage receptacle.

The support arm unit comprises a generally flexible support arm member that is operatively attached to the receptacle retention unit; wherein, the free end of the support arm member is provided with a generally rigid insert segment that is adapted to be interposed between opposed vertical surfaces in a vehicle interior, such as the window or door frame.

The stiffening unit comprises in general a pair of contoured rigid stiffening members which are adapted to laterally engage the flexible arm members of the support arm unit to provide rigidity to the engaged portions thereof.

Briefly stated, the aforementioned arrangement allows cups of varying diameters to be securely engaged within the receptacle retention unit; whereby the contents of the liquid receptacle will not be susceptible to spillage.

In addition, the flexible nature of the support arm member will permit at least a portion of the support arm unit to intimately conform to an interior surface of a vehicle; and finally, the stiffening unit may be selectively employed to provide rigidity to the otherwise flexible portion of the support arm unit.

BRIEF DESCRIPTION OF THE DRAWINGS

These and other objects, advantages, and novel features of the invention will become apparent from the detailed description of the best mode for carrying out the preferred embodiment of this invention which follows, particularly when considered in conjunction with the accompanying drawings, wherein.

BEST MODE FOR CARRYING OUT THE INVENTION

Figure 1:
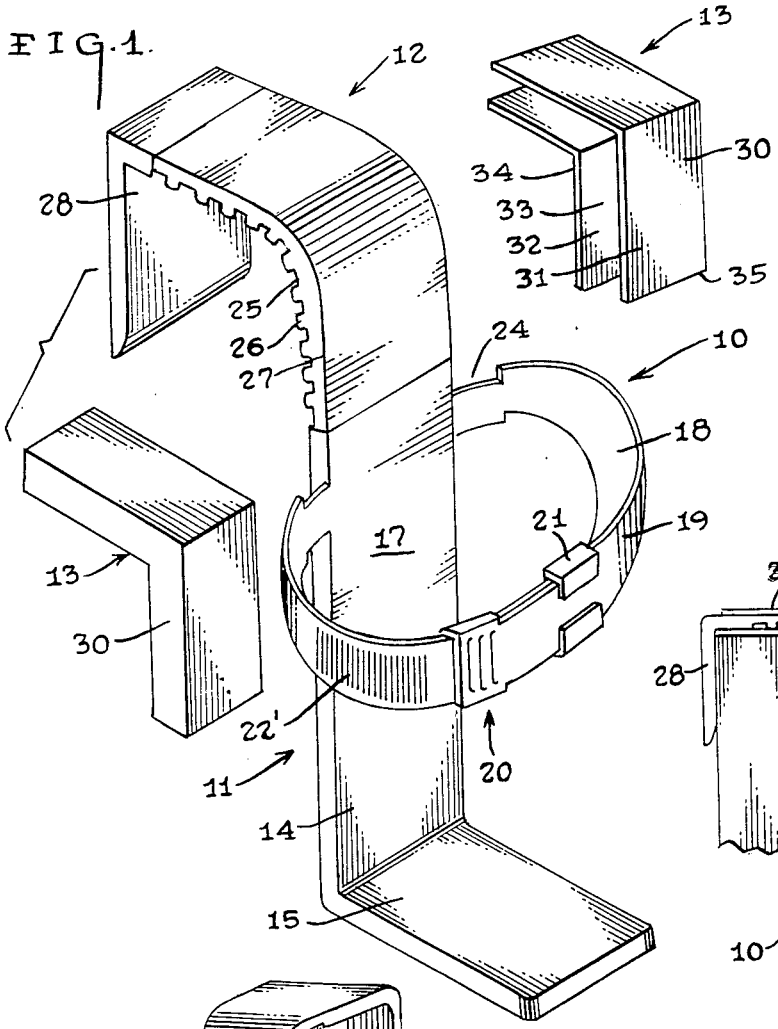
FIG. 1 is an exploded perspective view of the present invention.

As can be seen by reference to the drawings and in particular to FIG. 1, the cup retention apparatus of this invention is designated generally by the reference numeral (10). The cup retention apparatus (10) comprises in general an adjustable receptacle retention unit (11), a support arm unit (12), and a stiffening unit (13). These units will now be described in seriatim fashion.

As can be seen by reference to FIG. 1, the receptacle retention unit (11) comprises a generally L-shaped receptacle receiving member (14); wherein the foot (15) of the L-shaped receptacle receiving member (14) comprises a horizontally disposed support surface (16) for a receptacle; and wherein, the vertical leg (17) is provided with a pair of cooperating flexible arm members (18) on its upper end.

The arm members (18) comprise generally elongated flat flexible strap elements (19) provided with cooperating securing means (20) on their free ends. The cooperating securing means (20) comprise generally C-shaped clasp elements (21) which may releasably engage the intermediate portions (22) of the opposing strap elements (19).

The intermediate portions (22) of the strap elements (19) are provided with a saw-tooth recessed portion (22') which extends along a substantial portion of the running length of the arm members (18). In addition, cooperating saw-tooth recesses (23) are present on the interior of the C-shaped clasp elements (21) so as to more securely engage the intermediate portions (22) of the arm members (18).

Furthermore, the arm members (18) have opposed recesses (24) at their inboard end, proximate the juncture of the arm members (18) and the upper end of the receptacle receiving member (11). The recesses (24) are dimensioned to receive the C-shaped clasp elements (21) of the opposing arm member (18).

Still referring to FIG. 1, it can be seen that the support arm unit (12) comprises an elongated, partially flexible member (25) comprising an upper and a lower portion, wherein the lower portion of the support arm unit (12) is formed integrally with the upper portion of the receptacle retention unit (11), and is provided with a plurality of spaced, reduced thickness segments (26)

which function as discrete flexible hinged elements (27); and wherein the upper portion of the generally flexible support member (25) comprises an elongated generally rigid insert element (28).

Clearly shown in FIG. 1, the reduced thickness segments (26) extend to a point proximate the midpoint of the generally flexible support member (25), and the rigid insert element (28) forms the tapered free end of the support arm unit (12); wherein, the insert element (28) is dimensioned to be interposed intermediate a vehicle window and its associated support structure which is connected to the door frame.

As mentioned early in the specification, the cup retention apparatus (10) is further provided with a stiffening unit (13); wherein the stiffening unit (13) comprises at least one generally L-shaped stiffening member (30) with two generally perpendicularly disposed leg elements (31). The leg elements (31) comprise generally U-shaped channel members (32); wherein, the legs (33) and (34) are adapted to engage the front and back faces of the flexible portion (25) of the support arm unit (12); and wherein the base (35) of the channel members (32) is adapted to engage one side of the generally flexible support member (25).

In the preferred embodiment of the invention illustrated in the drawings, the stiffening unit (13) comprises a pair of generally L-shaped support members (30); wherein, the support members (30) may selectively engage opposite sides of the support arm unit (12).

Figure 3:
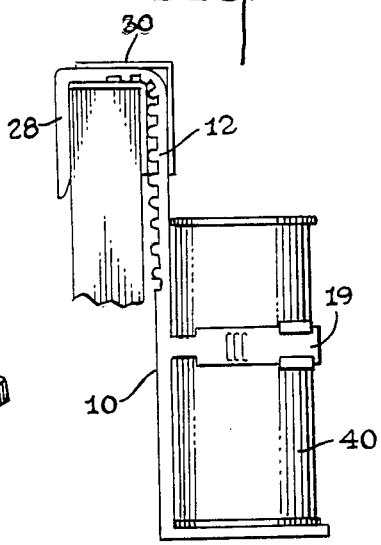
FIG. 3 is a side plan view of the apparatus.
Figure 2:
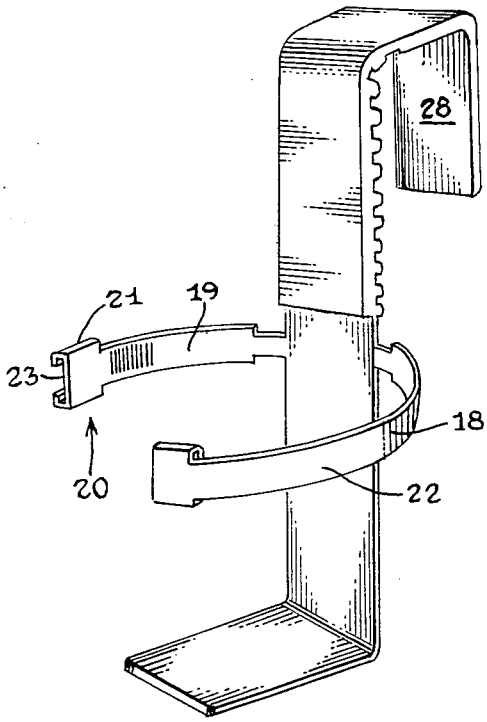
FIG. 2 is a perspective view of the apparatus in its assembled disposition.

As can best be appreciated by reference to FIG. 3, the cup retention apparatus (10) is secured in place by use of the support arm unit (12). In order to anchor the support arm unit (12), the insert element (28) is interposed intermediate a vehicle window and its associated support structure. The flexible support member (25) of the support arm unit (12) when allowed to hand freely, will naturally conform to the contours of the vehicle interior thereby creating a stable base for the receptacle retention unit (11).

At this juncture it is necessary for the flexible arm members (18) to be joined by their clasp elements (21) in order to encircle a receptacle (40); wherein, the clasp elements (21) are slidably engaged by slipping each clasp element (21) over the opposed recesses (24) on the opposed arm.

The receptacle retention unit (11) is now configured to receive a receptacle (40), such as a cup or can. the retention unit (11) is adapted to receive a beverage receptacle (40) by placing it within the circumference of the arm members (18) and resting it on the horizontally disposed support surface (16). In order to securely retain the receptacle (40), the arm members (18) are then adjusted to conform to the diameter of the receptacle (40); wherein, the clasp elements (21) are displaced along the arm members (18) so as to frictionally engage the periphery of a given receptacle (40) with the arm members (18).

At this juncture, the stiffening unit (13) may be deployed at a selected location along the length of the flexible member (25) of the support arm unit (12) to provide rigidity to the apparatus (10). This is accomplished by engaging the U-shaped channel member (32) of at least one of the L-shaped stiffening members (30) over the hinged portion of the flexible member (25) to impart a generally L-shaped rigid configuration to the normally flexible member (25) of the support arm unit (12).

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A cup retention apparatus for use in combination with the interior structural surfaces of a vehicle to support and engage different sized cups; wherein, the cup retention apparatus comprises:

an adjustable receptacle retention unit including a generally L-shaped receptacle receiving member having a pair of cooperating flexible arm members formed on the upper end of the receptacle receiving member; wherein, the flexible arm members are adapted to engage one another to frictionally engage the periphery of different sized cups;

a support arm unit comprising a partially flexible member having one end operatively associated with the upper portion of the receptacle retenion unit; wherein, the support arm unit also has a free end comprising an elongated generally rigid insert element that is adapted to engage selected interior structural surfaces of the vehicle to provide support and suspension for the cup retention apparatus; wherein the support arm unit comprises: of the support unit is formed integrally with the upper portion of the receptacle retention unit and the lower portion is further provided with a plurality of reduced thickness segments which function as discrete flexible hinged elements; and, a stiffening unit adapted to engage the flexible portion of the partially flexible member to impart rigidity to said flexible portion.

2. The cup retention apparatus as in claim 1; wherein, the stiffening unit comprises at least one generally L-shaped stiffening member dimensioned and adapted to slidingly and selectively engage one side of said partially flexible member.

3. The cup retention apparatus as in claim 2; wherein, the stiffening member comprises: two generally perpendicularly disposed leg elements 4. The cup retention apparatus as in claim 3; wherein, the leg elements comprise: generally U-shaped channel members.

5. The cup retention apparatus as in claim 1; wherein, the pair of cooperating flexible arm members are provided with securing means on their free ends.

6. The cup retention apparatus as in claim 5; wherein, the securing means comprise generally C-shaped clasp elements.

7. The cup retention apparatus as in claim 6; wherein, the inboard ends of each of the flexible arm members are provided with opposed recesses that are dimensioned to receive the C-shaped clasp elements of the other flexible arm member.

* * * * *